US006939026B2

(12) United States Patent
Gennrich et al.

(10) Patent No.: US 6,939,026 B2
(45) Date of Patent: Sep. 6, 2005

(54) SHUTTER ASSEMBLY FOR A LUMINAIRE

(75) Inventors: David James Gennrich, Madison, WI (US); Sheldon Roberts, Sun Prairie, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 104 days.

(21) Appl. No.: 10/651,273

(22) Filed: Aug. 28, 2003

(65) Prior Publication Data

US 2005/0047147 A1 Mar. 3, 2005

(51) Int. Cl.[7] ..... F21V 17/02

(52) U.S. Cl. ..... 362/322; 362/277; 362/283; 362/284; 362/321

(58) Field of Search ..... 362/277, 283–284, 362/319–324, 351–352

(56) References Cited

U.S. PATENT DOCUMENTS 2,625,087 A * 1/1953 Steineck ..... 396/336
4,208,100 A * 6/1980 Bischl ..... 359/234
4,210,955 A * 7/1980 Labrum ..... 362/321
4,395,104 A * 7/1983 Lange ..... 396/449
4,811,182 A * 3/1989 Solomon ..... 362/293
5,264,885 A * 11/1993 Haraguchi et al. ..... 396/448
5,510,969 A * 4/1996 Rodger et al. ..... 362/321
5,571,280 A * 11/1996 Lehrer ..... 362/352
5,653,519 A * 8/1997 Dobbs ..... 362/551
6,092,914 A * 7/2000 Esakoff et al. ..... 362/268
6,102,554 A * 8/2000 Wynne Willson et al. .. 362/281
6,550,939 B2 * 4/2003 Reinert ..... 362/321
6,744,693 B2 * 6/2004 Brockmann et al. ..... 362/321
6,837,596 B2 * 1/2005 Tanaka et al. ..... 362/277

* cited by examiner

*Primary Examiner*—Stephen Husar
*Assistant Examiner*—Jason Han
(74) *Attorney, Agent, or Firm*—Greer, Burns & Crain, Ltd.; Philip M. Kolehmainen

(57) ABSTRACT

A shutter section includes a stack of circular plates independently rotatable in a nest formed as a laminar formation of rings. The plates have central openings defining a light path. Four central plates in the stack are shutter guide plates with radial guide slots slideably holding shutter blades. Two outer pairs of plates are shutter drive plates connected by cams to the shutter blades. Simultaneous rotation of a shutter guide plate and associated shutter drive plate causes rotation of an associated shutter blade around the light path. Rotation of a shutter drive plate while the associated shutter guide plate is stationary causes the cam to move the associated shutter blade radially. The nest is enclosed by end plates. A motor section has motors driving pinions to rotate the circular plates. The circular plates, rings pinions and shutter blades are made of sheet metal.

30 Claims, 5 Drawing Sheets

[Reference character 78 and lead line added]

SHUTTER ASSEMBLY FOR A LUMINAIRE

FIELD OF THE INVENTION

The present invention relates to a shutter assembly, and more particularly to an improved framing shutter assembly for a luminaire.

DESCRIPTION OF THE PRIOR ART

Theatrical luminaires can be provided with shutters to provide a projected, framed light beam of a selected shape and size. In typical arrangements, four shutter blades are mounted within the luminaire housing for movement relative to the light path. The blades can be translated radially into and out of the light path and each can be rotated in the peripheral direction around of the light beam. By arranging the shutter blades, the projected light beam can be square or rectangular or have other straight sided shapes such as triangular or trapezoidal, and the projected shape can be oriented at a selected rotational position.

In the past, manually operated shutters were common. In a manually operated shutter assembly, handles projecting from the sides of the luminaire are manipulated to place the shutter blades in the desired positions. Because of the inconvenience of manual adjustment for each modification in the light beam shape, a need has arisen for a motor operated, automated, remotely controlled shutter assembly.

Existing automated shutter assemblies are subject to disadvantages. Typically, known arrangements are very complex, requiring many intricate parts and assembly operations and resulting in high material and assembly labor costs, large size and poor reliability. Large size is a problem because it may require a large luminaire housing to contain the shutter assembly and because it may make it difficult to locate all of the shutter blades at or very close to the desired optical point such as at a focus point along the light path. In many designs the motors used for operating the shutters have been mounted for movement in the assembly and have been drivingly connected to the shutters by complicated and expensive mechanisms. A disadvantage of movably mounted motors is the need to route electrical cabling to the moving motors. There is a long standing need for a simple, inexpensive, reliable and compact framing shutter assembly for a luminaire.

U.S. Pat. No. 6,550,939 discloses a shutter apparatus of a complex design that is expensive to make and assemble. It has a number of individual shutter assemblies, each including a shutter blade that is moved by a system of shutter blade drive motors and linear driving members. In addition, a further motor is used to rotate the entire shutter system including the shutter blade drive motors and linear driving members.

SUMMARY OF THE INVENTION

A primary object of the present invention is to provide an improved shutter assembly for a luminaire. More specific objects of the invention are to provide a framing shutter assembly that is very simple, easy and inexpensive to fabricate and assemble, reliable, and compact, thereby overcoming disadvantages of known shutter assemblies and fulfilling the long standing need for a simple, reliable and compact framing shutter assembly for a luminaire.

In brief, in accordance with the invention there is provided a framing shutter assembly for a luminaire providing a beam of light. The framing shutter assembly includes a stack of plates having aligned central openings defining a light path through the shutter assembly. The light path has a longitudinal axis and a plurality of the plates are mounted for rotation around the axis. The assembly includes a shutter blade. A first of the plurality of plates is a rotation guide plate having a guide slot extending from the central opening of the rotation guide plate. The guide slot receives the shutter blade and mounts the shutter blade for translational motion into and out of the central opening of the first plate for selectively blocking a portion of the light path. A second of the plurality of plates is a translation guide plate. A cam and follower combination includes a first camming element on the translation guide plate and a second camming element on the shutter blade engaging the first camming element and moving the shutter blade along the guide slot in response to rotation of the translation guide plate relative to rotation the guide plate.

BRIEF DESCRIPTION OF THE DRAWING

The present invention together with the above and other objects and advantages may best be understood from the following detailed description of the preferred embodiment of the invention illustrated in the drawings, wherein.

DETAILED DESCRIPTION OF THE PREFERRED EMBODIMENT

Figure 1:
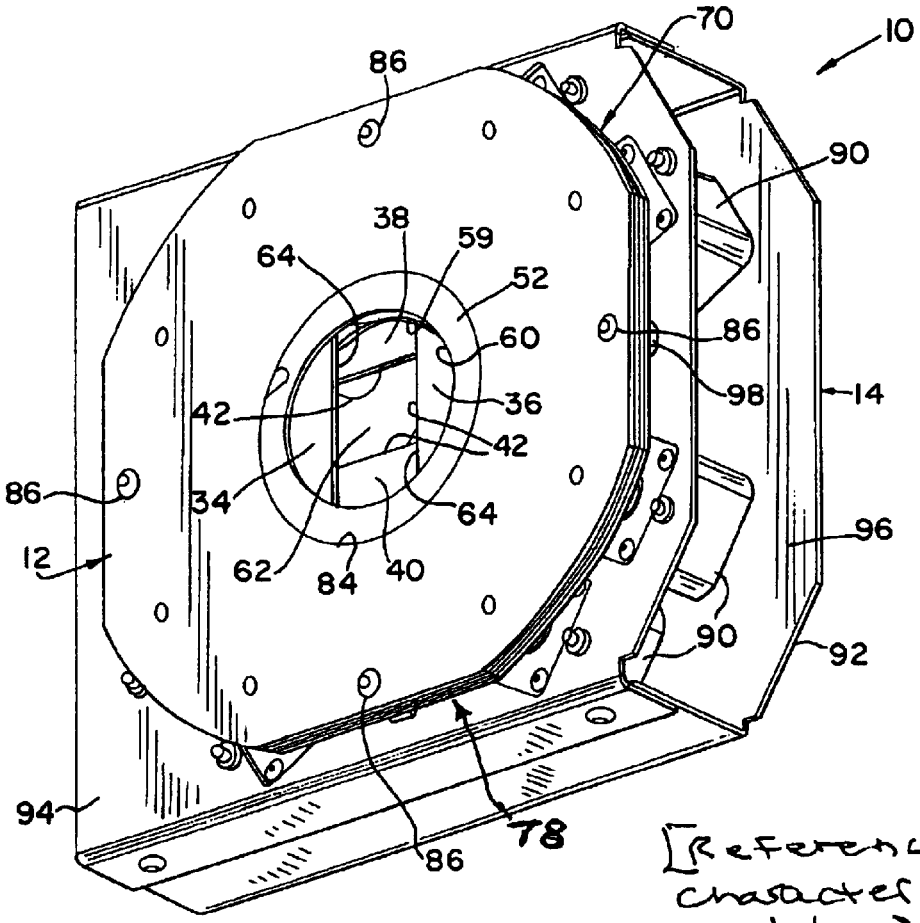
FIG. 1 is a front isometric view of a shutter assembly constructed in accordance with the present invention.

Having reference now to the drawing, a framing shutter assembly generally designated as 10 is seen in FIG. 1. The shutter assembly 10 is constructed in accordance with the principles of the present invention and includes a shutter section 12 and a drive motor section 14. In accordance with a feature of the invention, the components of the shutter section are made from sheet metal to provide a compact and inexpensive construction that is easily fabricated and assembled, and is sturdy, simple and reliable.

Figure 2:
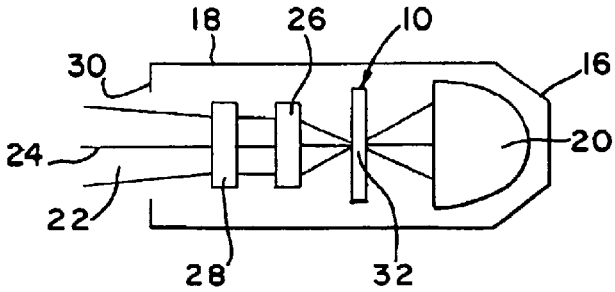
FIG. 2 is a simplified, diagrammatic view of a luminaire including the shutter assembly of FIG. 1.

FIG. 2 is a simplified diagrammatic view of a theatrical luminaire 16 provided with the shutter assembly 10 of the present invention. A luminaire housing 18 contains a light source including a reflector 20. A beam 22 of light is emitted from the reflector 20 and travels in the direction of its longitudinal axis 24 through a lens system including rear and front optical lenses 26 and 28. The light beam 22 is projected through a light exit opening 30 in the housing 18. The shutter assembly 10 is mounted within the housing 18 at a focus point 32 of the reflected light beam 22.

The framing shutter assembly 10 includes four shutter blades 34, 36, 38 and 40. Each of these blades 34–40 can be moved in a translational direction, radially inward or outward, in order to block a selected portion of the light beam 22. In addition, each of the shutter blades 34–40 can be rotated around the axis 24. The shutter blades 34–40 are preferably identical, although if desired they could differ in shape. The shutter blades 34–40 have straight inner edges 42, although other configurations are possible. The range of translational and rotational motion of the shutter blades 34–40 is such that the shutter assembly 10 can provide a projected beam of light having any three sided or four sided shape with a wide variation in size.

The shutter section 12 includes eight aligned, stacked circular plates or disks 44, 46, 48, 50, 52, 54, 56 and 58. The circular plates form a stack 59. Each of the plates 44–58 includes a central aperture 60 providing a light path 62 through the stack 59 for the light beam 22 to travel axially through the shutter assembly 10.

Four of the circular plates 44, 46, 48 and 50 are rotation guide plates, each supporting one of the shutter blades 34, 36, 38 and 40. The plates 44–50 each have a shutter guide slot 64 extending radially outward from the central aperture 60. The width of the guide slots 64 corresponds to the width of the shutter blades 34–40 and the shutter blades 34–40 are slideably received in the guide slots 64 for sliding translational motion in the radial direction relative to the light path 62.

The remaining four circular plates 52, 54, 56 and 58 are shutter drive plates. Each of the plates 52–58 has an arcuate cam slot 66. The slots 66 extend in curved, spiral like paths between radially inner and radially outerends. Each shutter blade 34–40 has a cam follower 68 received in one of the cam slots 66. Each cam follower 68 engages only one of the cam slots 66.

Figure 4:
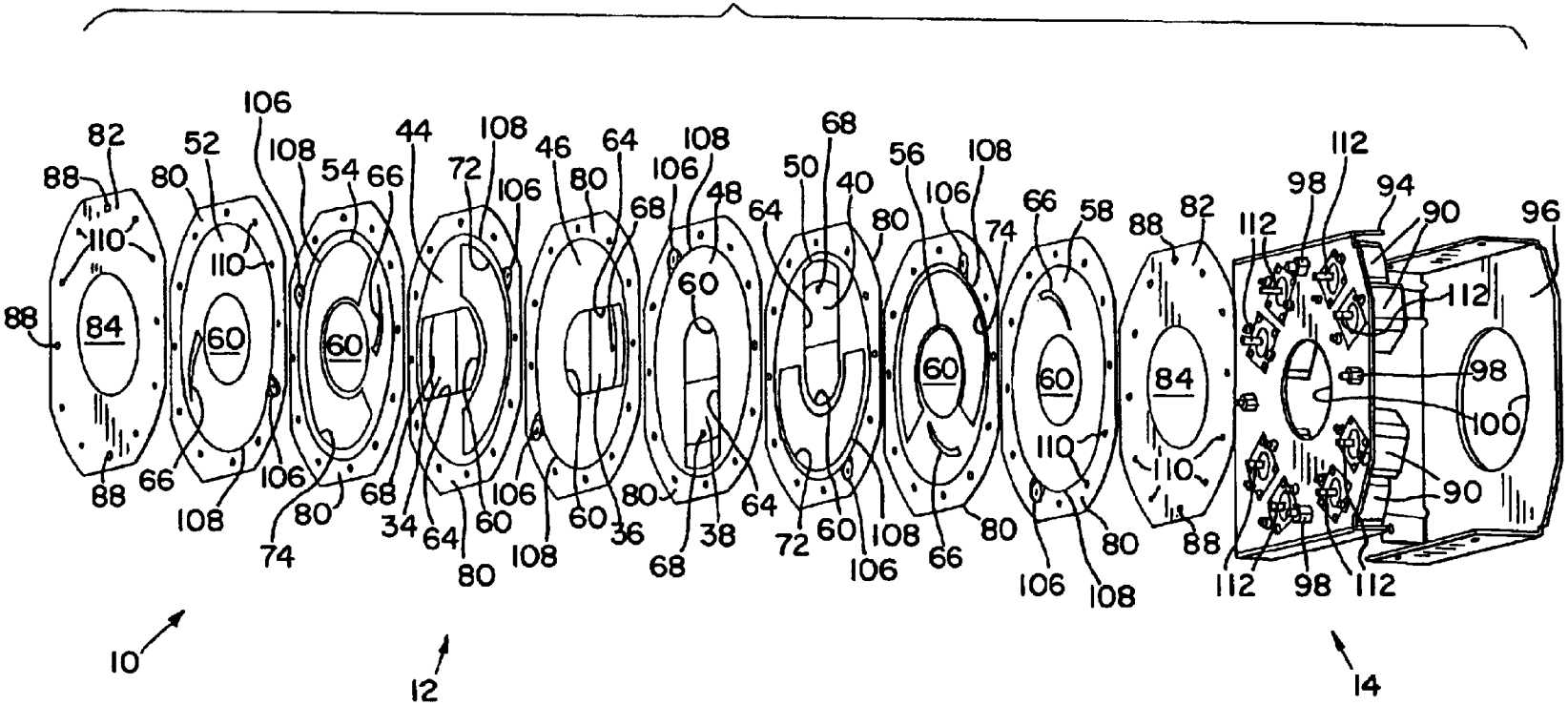
FIG. 4 is an exploded front isometric view of the shutter assembly.

The association between the shutter blades 34–40, the shutter guide plates 44–50 and the shutter drive plates is as follows (see FIG. 4).

34—44—52: shutter blade 34 slides in the guide slot 64 of the shutter guide plate 44, and the cam follower 68 of the shutter blade 34 mates with the cam slot 66 of the shutter drive plate 52.

36—46—54: shutter blade 36 slides in the guide slot 64 of the shutter guide plate 46, and the cam follower 68 of the shutter blade 36 mates with the cam slot 66 of the shutter drive plate 54.

38—48—56: shutter blade 38 slides in the guide slot 64 of the shutter guide plate 48, and the cam follower 68 of the shutter blade 38 mates with the cam slot 66 of the shutter drive plate 56.

40—50—58: shutter blade 40 slides in the guide slot 64 of the shutter guide plate 50, and the cam follower 68 of the shutter blade 40 mates with the cam slot 66 of the shutter drive plate 58.

The circular plates 44–58 are all mounted for rotation in a nest or cradle structure 70, and each can be rotated independently of the others. The shutter guide plates 44 and 50 include arcuate clearance openings 72 that permit the cam followers 68 of the shutter blades 36 and 38 to extend through the plates 44 and 50 to the cam slots 66 of their associated shutter drive plates 54 and 56. The shutter drive plates 54 and 56 include arcuate clearance openings 74 that permit the cam followers 68 of the shutter blades 34 and 40 to extend through the shutter drive plates 54 and 56 to the cam slots 66 of their associated shutter drive plates 52 and 58.

To rotate one shutter blade around the light beam axis 24, its associated shutter guide plate and shutter drive plate are rotated simultaneously. To translate one shutter blade radially with respect to the light path 62, its associated shutter guide plate is held stationary while its associated shutter drive plate is rotated. Rotation of the cam slot 66 of the rotating shutter drive plate moves the cam follower 68 of the associated shutter blade, and thus the shutter blade itself, radially in or out.

Figure 5:
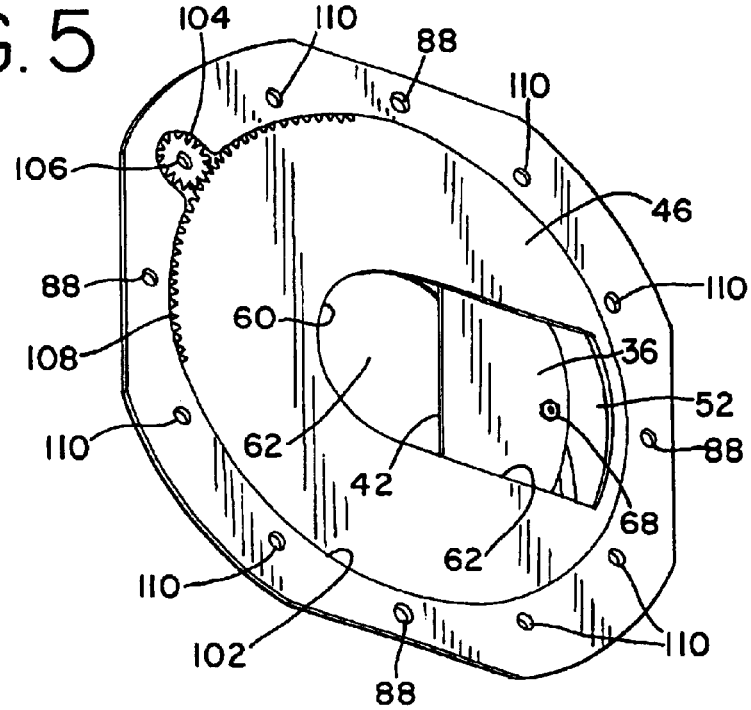
FIG. 5 is a front isometric view of one shutter subassembly of the shutter assembly including a shutter, shutter guide plate and shutter drive plate.
Figure 6:
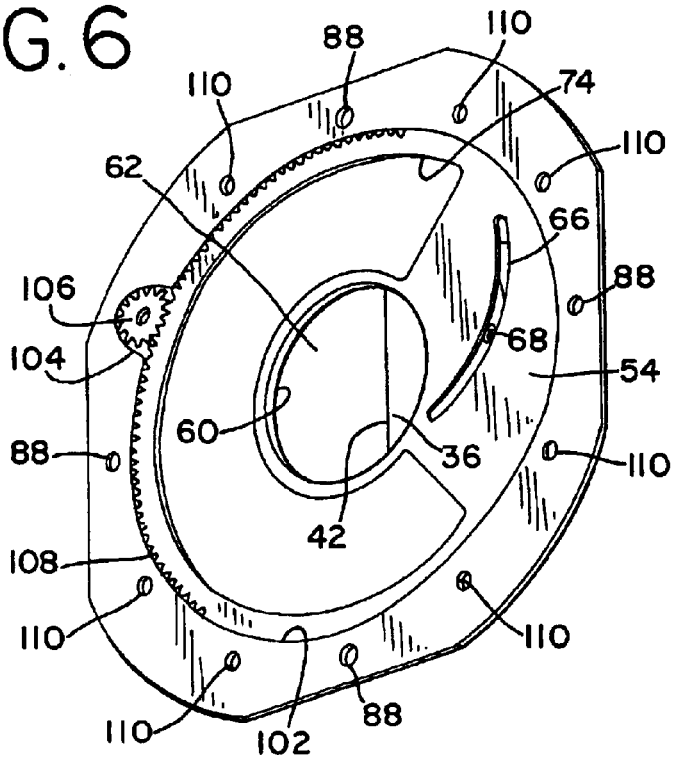
FIG. 6 is a rear isometric view of the shutter subassembly of FIG. 5.

One set of associated shutter blade 36, shutter guide plate 46 and shutter drive plate 54 is illustrated in FIGS. 5 and 6. When the shutter guide plate 46 and the shutter drive plate 54 are rotated simultaneously, the shutter blade 36 is rotated in a circular direction around the axis 24 of the light path 62, without any radial motion. When the shutter guide plate 46 is held stationary, and the shutter drive plate 54 is rotated, the rotating cam slot 66 causes the cam follower 68 on the shutter blade 36, together with the shutter blade 36, to move radially inward or radially outward, without rotational motion. If desired, combinations of radial and rotational shutter motions are also possible, for example by rotating the plates 46 and 54 at different speeds and/or in different directions.

The circular plates 44–58 are made of a flat planar material, preferably sheet metal. Similarly the shutter blades 34–40 are also made of a flat planar material, preferably sheet metal. Because of the heat of the light beam, stainless steel sheet metal is the preferred material for the shutter blades 34–40. The same stainless steel material can be used for the circular plates 44–58, or alternatively the circular plates 44–58 may be made of a less expensive steel sheet metal. The thickness of the shutter blades 34–40 does not exceed the thickness of the shutter guide plates 44–50 in order that the shutter blades can slide along the guide slots 64. The cam followers 68 can be press fit into openings 75 (FIG. 7) in the shutter blades 34–40. The cam followers 68 may be PEM® fasteners from PEM Fastening Systems. 5190 Old Easton Road, Danboro, Pa. 18916, or studs or buttons that are attached in a similar manner to in the openings 75.

Figure 7:
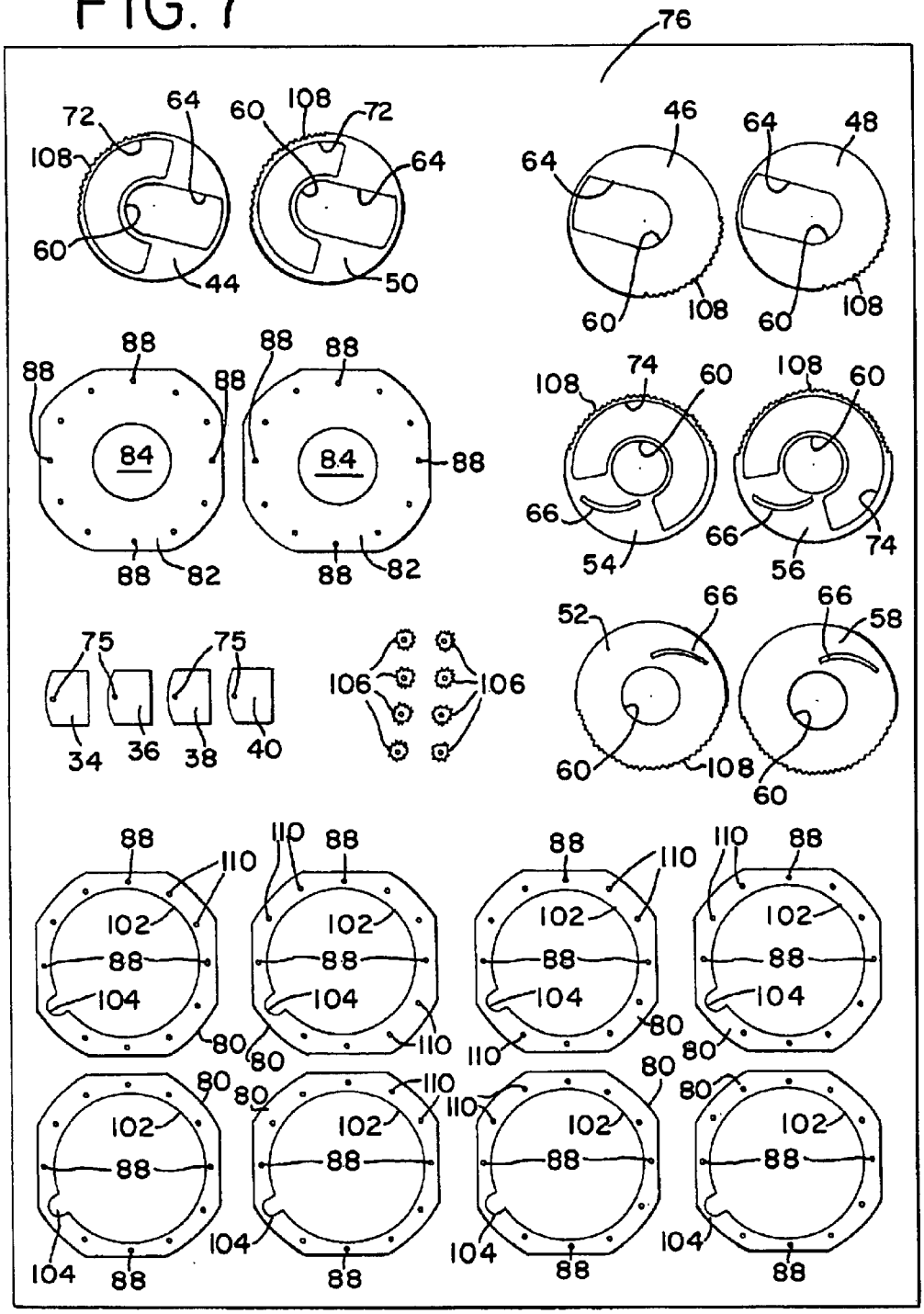
FIG. 7 is a plan view of a sheet of metal with a pattern for severing from the sheet components of the shutter assembly from the sheet.

It is preferred that the thickness of all of the circular plates 44–58 and the thickness of all of the shutter blades 34–40 is the same. This permits all of these parts to be cut or severed from a single sheet of metal. An example of this method is seen FIG. 7 where there is shown a single sheet 76 of metal illustrated with a pattern of sheet metal components for the shutter section 12 of the shutter assembly 10. The illustrated patterned parts can be severed by any desired process such as laser cutting or stamping. The pattern arrangement of FIG. 7 is for illustrative purposes only, and in actual manufacture other approaches can be taken, such as making numerous iterations of single parts in sequence from an elongated roll or web of sheet metal.

A preferred material for the sheet 76 is twenty-two gauge sheet steel having a thickness of 0.030 inch. If the shutter blades are made from more heat tolerant stainless steel sheet, their thickness can be the same. As seen in FIG. 4, the shutter guide plates 44–50 are located next to one another at the center of the stack 59. This places all of the four shutter blades 34–40 in a closely spaced array along the light beam axis. The total beam depth of the shutter blades is only 0.120 inch, so that the entire shuttering process is performed at or very close to the light beam focus point 32. This results in a clear, sharply framed, shuttered pattern of the projected light beam 22.

The stack of four shutter guide plates 44–50 is flanked in front by the shutter drive plates 52 and 54, and at the rear by the shutter drive plates 56 and 58. An advantage of the stack 59 of circular plates 44–58 is that they are self supporting in the axial direction. In addition, the shutter blades are axially captured between adjacent circular plates on both sides so that they are held in the guide slots 64 and yet are free to move radially.

The nest 70 is formed of a laminar formation 78 of a number of sheet metal rings 80. In the preferred arrangement, there are eight rings 80, equal in number to the eight circular plates 44–58. The ends of the nest 70 are closed by front and rear end plates 82. As seen in FIG. 7, the rings 80 are severed from the same metal sheet 76 as the circular plates 44–58. This has the advantage that the axial depth of the nest 70 is equal to the axial thickness of the stack 59 so that the circular plates 44–58 do not bind or become clamped tightly in the nest 70. Preferably the end plates 82 are also severed from the sheet 76. Another advantage is that sheet thickness tolerance variations from sheet to sheet do not cause clamping or binding of the circular discs 44–58.

Figure 3:
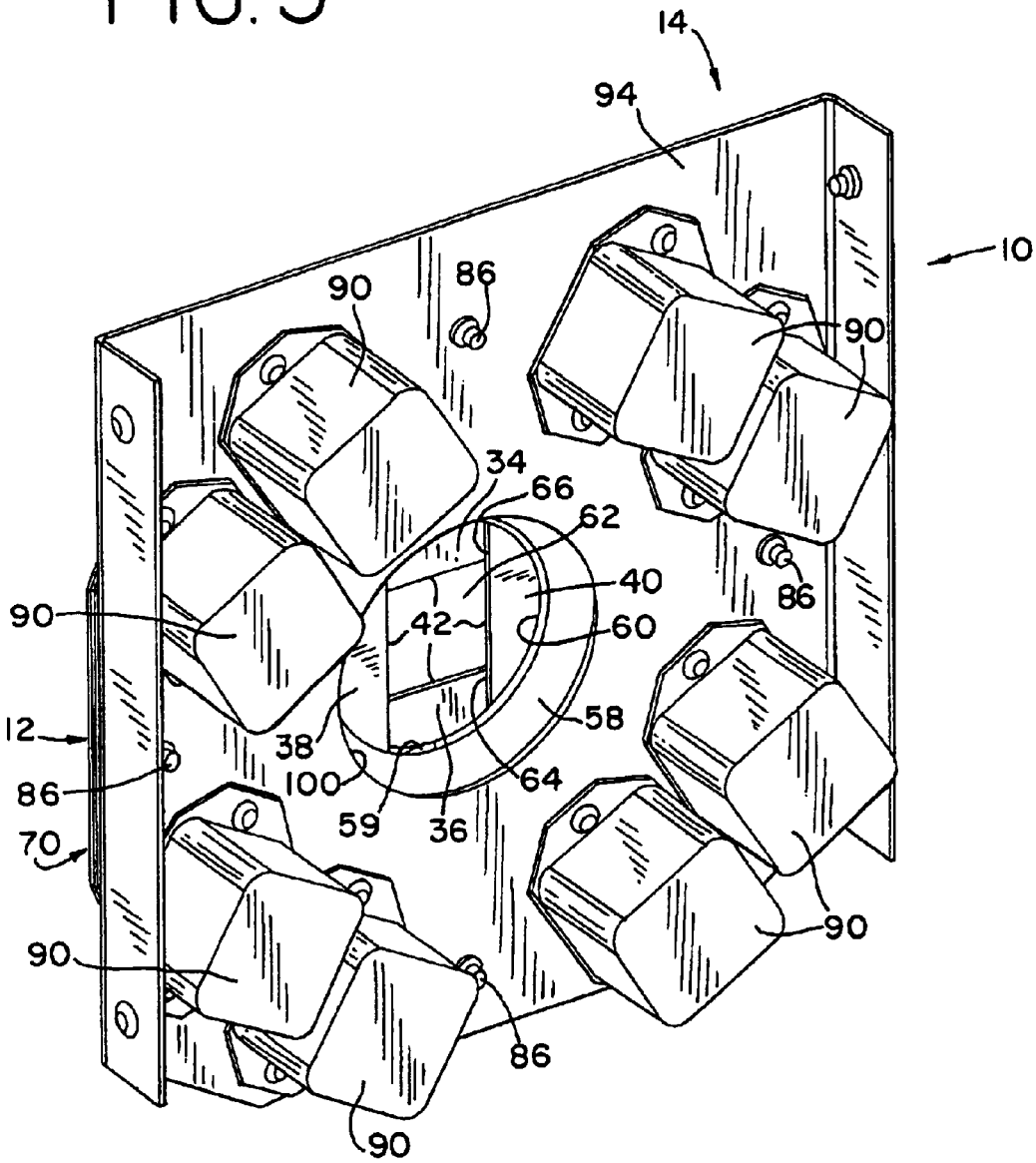
FIG. 3 is a rear isometric view of the shutter assembly with the motor housing cover removed.

The end plates 82 have central apertures 84 permitting the light beam 22 to travel through the shutter assembly 10. The nest 70 is held together by fasteners 86 (FIGS. 1 and 3) extending through aligned fastener holes 88 in the rings 80 and in the end plates 82. The nest 70 is assembled with the stack 59 in place within circular central holes 102 in the rings 80. Preferably a lubricant such as a dry lubricant is used in the stack 59 to reduce friction. The end plates 82 are thin enough to flex slightly and act as springs biasing the stack 59 together while permitting independent rotation of the circular plates 44–58 and radial motion of the shutter blades 34–40.

The drive motor section 14 includes eight motors 90 for independently rotating the eight circular plates 44–58. The motors 90 are enclosed in a motor housing 92 including a base 94 and a cover 96. The motors 90 are fastened to the base 94, Nuts 98 (FIG. 4) on the fasteners 86 act as stand-offs to hold the shutter section 12 spaced from and parallel to the motor housing 92. The motor housing 92 and the motors 90 are stationary, and electrical connections can easily be made to operate the motors 90. The base 94 and cover 96 include central openings 100 for passage of the light beam 22.

Fabrication cost and assembly cost of the shutter section is reduced by the use of common parts, and the number of different parts is minimal. Shutter guide plates 44 and 50 are identical. Shutter guide plates 46 and 48 are identical. Shutter drive plates 52 and 58 are identical. Shutter drive plates 54 and 56 are identical. Shutter blades 34–40 are identical. End plates 82 are identical. The eight sheet metal rings 80 are identical.

Each of the identical rings 80 includes a circular central opening 102 slightly larger than the diameter of the circular plates 44–58, and a recess 104 adjoining the central opening 102. In the laminar formation 78, the eight rings are oriented by reversing and rotating them so that the recesses are circumferentially spaced apart in a symmetrical pattern around the axis 24. Each of the recesses 104 receives a pinion gear 106. The pinion gears 106 are identical to one another and preferably are cut from the metal sheet 76 so that their thickness is the same as the thickness of the rings 80 and of the circular plates 44–58.

Each of the circular plates 44–58 is formed with gear teeth 108 for at least part of its periphery. In the stack 59, the gear teeth 108 of each circular plate 44–58 register with one of the recesses 104. Each of the pinion gears 106 meshes with the gear teeth 108 of one of the circular plates 44–58 in order to independently rotate the plates 44–58.

Each ring 80, in addition to the recess 104, includes seven drive openings 110 in the same symmetrical pattern as the pattern of recesses 104 in the formation 78. The end plates 82 also have the pattern of drive openings 110. As a result, the drive openings 108 align to form eight drive passages extending axially through the laminar ring formation 78, and each of these passages intersects one of the recesses 104.

The drive motors 90 are arrayed on the base 94 in the same symmetrical pattern as the recesses 104 and drive openings 110. Each motor 90 includes a drive shaft 112 extending into the formation 78 and drivingly engaging one pinion gear 106. The drive shafts 112 can be D shaped to engage a similar shaped central hole in the pinion gears 106. Operation of any one of the motors 90 results in rotation of the corresponding one of the circular plates 44–58.

Because the pinion gears 106 are circumferentially offset from one another, each is held in its corresponding recess 104 by the adjacent plates of the stack 59 at both sides. The gears 106 associated with the plates 52 and 58 are also held by the end plates 82. The gears 104 are therefore reliably captured in position without any additional supports or guides.

While the present invention has been described with reference to the details of the embodiment of the invention shown in the drawing, these details are not intended to limit the scope of the invention as claimed in the appended claims.

What is claimed is:

1. A framing shutter assembly for a luminaire providing a beam of light, said framing shutter assembly comprising:

a stack of plates having aligned central openings defining a light path through the shutter assembly, said light path having a longitudinal axis, a plurality of said plates being mounted for rotation relative to one another around said axis;

a shutter blade;

a first of said plurality of plates being a rotation guide plate having a guide slot extending from said central opening of said rotation guide plate, said guide slot receiving said shutter blade and mounting said shutter blade for translational motion into and out of said central opening of said first plate for selectively blocking a portion of said light path;

a second of said plurality of plates being a translation guide plate; and a cam and follower combination including a first camming element on said translation guide plate and a second camming element on said shutter blade engaging said first camming element and moving said shutter blade along said guide slot in response to rotation of said translation guide plate relative to said rotation guide plate.

2. A framing shutter assembly as claimed in claim 1, said first and second camming elements comprising an arcuate slot in said translation guide plate and a cam follower projection mounted on said shutter blade.

3. A framing shutter assembly as claimed in claim 1, said shutter blade being coplanar with said rotation guide plate.

4. A framing shutter assembly as claimed in claim 3, said shutter blade, said rotation guide plate and said translation guide plates all being made of sheet metal.

5. A framing shutter assembly as claimed in claim 3, said shutter blade, said rotation guide plate and said translation guide plates all being made of sheet metal having the same thickness.

6. A framing shutter assembly as claimed in claim 3, said shutter blade, said rotation guide plate and said translation guide plates all being made from a single piece of sheet metal.

7. A framing shutter assembly comprising:

a plurality of sheet metal rings having circular central openings, said rings being in a laminar formation with said circular central openings aligned to define a circular cylindrical nest;

a stack of a plurality of sheet metal circular plates received in said nest for rotation relative to one another, said plates having central apertures aligned to define a light path;

four of said circular plates being shutter guide plates having guide slots extending outward from said central apertures; and four shutter blades slideably received in said guide slots for movement into and out of said light path.

8. The framing shutter assembly of claim 7, said plurality of sheet metal rings being equal in number to said plurality of circular plates.

9. The framing shutter assembly of claim 8, said sheet metal rings and said circular plates having the same thickness.

10. The framing shutter assembly of claim 9, said shutter blades being made of sheet metal having the same thickness as said circular plates.

11. The framing shutter assembly of claim 9, said sheet metal rings and said circular plates being made from a single sheet of metal.

12. The framing shutter assembly of claim 7, another four of said circular plates being shutter drive plates having cam structures, and said shutter blades having cam followers mating with said cam structures.

13. The framing shutter assembly of claim 12, said shutter guide plates being adjacent to one another in said stack.

14. The framing shutter assembly of claim 13, said shutter guide plates being sandwiched between pairs of said shutter drive plates.

15. The framing shutter assembly of claim 14, further comprising a pair of end plates attached to opposite ends of said nest to retain said circular plates in said nest, said end plates having central apertures aligned with said light path.

16. The framing shutter assembly of claim 12, said shutter guide plates including two pairs of identical circular plates and said shutter drive plates including two pairs of identical circular plates.

17. The framing shutter assembly of claim 7, each said sheet metal ring having a drive member receiving recess adjoining said circular central opening, and a plurality of drive members each received on one of said drive member receiving recesses and engaging the periphery of one of said circular plates.

18. The framing shutter assembly of claim 17, said circular plates having peripheral gear teeth and said drive members comprising sheet metal pinion gears meshed with said gear teeth. The framing shutter assembly of claim 7, each said sheet metal ring having a drive member receiving recess adjoining said circular central opening, and a plurality of drive members each received on one of said drive member receiveing recesses and engaging the periphery of one of said circular plates.

19. The framing shutter assembly of claim 17, all of said sheet metal rings being identical.

20. The framing shutter assembly of claim 19, said sheet metal rings being oriented in said laminar formation so that said drive member receiving recesses are arrayed peripherally around the circumference of said nest.

21. The framing shutter assembly of claim 20, further comprising a pair of end plates attached to opposite ends of said nest to retain said circular plates in said nest, said end plates having central apertures aligned with said light path, a plurality of drive openings extending through said laminar formation intersecting said drive member receiving recesses, and a plurality of motors mounted adjacent at least one of said end plates and having drive shafts extending through said drive openings and connected to said drive members.

22. A framing shutter assembly for shaping a beam of light, said framing shutter assembly comprising:

a stack of circular disks made of sheet material, said disks being mounted for rotation relative to one another around a common axis;

said disks having aligned central openings defining a light path for the beam of light;

a plurality of shutter blades;

a first plurality of said disks having recesses supporting said shutter blades for movement into and out of said light path; and a second plurality of said disks having drive members engaging said shutter blades.

23. A framing shutter assembly as claimed in claim 22, further comprising a plurality of drivers for rotating said disks.

24. A framing shutter assembly as claimed in claim 23, said drivers including motors.

25. A framing shutter assembly as claimed in claim 22, further comprising a plurality of drive motors, and a plurality of drive members coupled between said drive motors and said disks.

26. A shutter controlling subassembly for a shutter assembly, said shutter controlling subassembly comprising:

a shutter blade;

a first guide plate having a slot capturing said shutter blade in said slot in an orientation coplanar with said first guide plate;

a light path extending through said slot;

said slot holding said shutter blade for sliding movement within said slot relative to said light path;

a second guide plate parallel to said first guide plate;

a plate mounting structure mounting said first and second guide plates for simultaneous rotation and for independent rotation relative to one another; and first and second cam elements defined respectively on said second guide plate and on said shutter blade, said cam elements engaging one another for sliding said shutter blade in said slot in response to rotation of said first guide plate relative to said second guide plate.

27. A method of making components of a framing shutter assembly from a single sheet of metal, said method comprising:

severing the following parts from the single sheet of metal:

a plurality of shutter blades a plurality of rotation guide plates having central openings and guide slots for receiving the shutter blades; and a plurality of translation guide plates having central openings and cams for translating the shutter blades;

loading the shutter blades into the guide slots in the rotation guide plates; and stacking the rotation guide plates and the translation guide plates with their central openings in alignment.

28. The method of claim 27 further comprising:

severing from the single sheet of metal a plurality of ring members equal in number to the aggregate number of the rotation guide plates and the translation guide plates;

fastening the ring members to one another to form a nest for the stack of rotation guide plates and translation guide plates; and placing the stack of rotation guide plates and translation guide plates into the nest.

29. The method of claim 28 further comprising:

making gear teeth on the peripheries of the rotation guide plates and the translation guide plates;

forming pinion gear cradles in the gear members;

said fastening step including locating the pinion gear cradles at peripherally spaced locations around the nest, each in alignment with the gear teeth of one of the rotation guide plates and the translation guide plates;

severing from the same sheet of metal a plurality of pinion gears; and loading the pinion gears into the pinion gear cradles in engagement with the gear teeth of the rotation guide plates and the translation guide plates.

30. The method of claim 29 further comprising:

retaining the stack of rotation guide plates and translation guide plates and the pinion gears by attaching end plates to the nest at opposite ends of the stack of rotation guide plates and translation guide plates.

* * * * *